US007234994B2

(12) United States Patent
Fildan et al.

(10) Patent No.: US 7,234,994 B2
(45) Date of Patent: Jun. 26, 2007

(54) BRASSIERE WITH SOFT/HARD UNDERWIRE ASSEMBLY

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

(21) Appl. No.: 11/251,573

(22) Filed: Oct. 14, 2005

(65) Prior Publication Data

US 2007/0087659 A1 Apr. 19, 2007

(51) Int. Cl.

| | |
|---|---|
| ***A41C 3/14*** | (2006.01) |
| *A41C 3/10* | (2006.01) |
| *A41C 3/12* | (2006.01) |

(52) U.S. Cl. ..... 450/41; 450/47; 450/51

(58) Field of Classification Search ..... 450/41–53, 450/54–56

See application file for complete search history.

(56) References Cited

U.S. PATENT DOCUMENTS

| | | | | |
|---|---|---|---|---|
| 2,595,088 | A * | 4/1952 | Licht | 450/52 |
| 3,562,802 | A * | 2/1971 | Avis | 450/52 |
| 6,346,028 | B1 * | 2/2002 | Fildan et al. | 450/41 |
| 6,447,365 | B1 * | 9/2002 | Powell et al. | 450/41 |

* cited by examiner

*Primary Examiner*—Gloria M. Hale
(74) *Attorney, Agent, or Firm*—Andrew Wilford

(57) ABSTRACT

A U-shaped hard underwire is rolled into a soft plastic body which forms a pocket for the breast when it is incorporated into a brassiere cup. The hard underwire has two arcuate portions separated by an arcuate slot so that one portion can swing relative to the plane of the underwire.

25 Claims, 6 Drawing Sheets

BRASSIERE WITH SOFT/HARD UNDERWIRE ASSEMBLY

FIELD OF THE INVENTION

The present invention relates to a brassiere having a soft/hard underwire assembly with a dual (i.e. soft/hard) character.

BACKGROUND OF THE INVENTION

The use of an underwire as part of a brassiere frame has become common. The underwire, of metal, plastic-coated metal or plastic generally is received in a tubular pocket below each cup and lies along the sternum of the wearer substantially at the junction of the breast with the chest wall. Each cup is provided with such an underwire which maintains the configuration of the cup and contributes the support of the breast.

In the past, problems have been encountered with such underwires. For example some underwire designs tended to poke through the fabric or to shift in the fabric pocket which was provided.

The pull on the underwire when the brassiere is fastened, because of the tension applied around the back of the wearer, tended to spread the underwire which generally had a U or C shape.

Frequently the stiffness of the underwire rendered the brassiere uncomfortable and often the lack of ability of the underwire to deform out of its plane caused discomfort as well. When efforts were made in the past to make the underwire more flexible, it tended to lose its stabilizing function.

Furthermore, techniques for inserting the underwire, anchoring the underwire or generally assembling an underwire to the cup and other structures of the brassiere made fabrication complex and expensive. In particular, the tension on the underwire when the brassiere was tightened around the back of the wearer could not be counteracted in the past except by making the wiring so stiff that its breast-shaping and supporting function was defeated.

An effort to overcome at least some of these disadvantages is found in U.S. Pat. No. 6,447,365 which describes a brassiere which ultimately was found to be impractical because of the stiffness of the armature embedded in the softer surround.

OBJECTS OF THE INVENTION

It is therefore the principal object of our present invention to provide an improved underwire structure which can overcome all of the drawbacks enumerated previously and provide improved comfort, shaping, support and convenience of manufacture for a brassiere.

Another object of this invention is to provide a brassiere with an improved underwire structure.

SUMMARY OF THE INVENTION

These objects and others which will become apparent hereinafter are attained, in accordance with the invention in an underwire assembly adapted to be incorporated into a brassiere and comprising:

a generally flat U-shaped hard underwire adapted to be positioned in a brassiere below in a cup thereof and along the chest of a wearer, the underwire being formed with two parallel arcuate portions joined at respective ends and separated by an arcuate slot between the ends; and a soft plastic body in which the hard underwire is embedded, ensheathing the hard underwire along a bottom of the body and having an apron along a concave side of the body lying at an angle to a plane of the hard underwire so that the body and the underwire form a pocket receiving a breast of the wearer in the cup.

The brassiere in turn comprises:

a generally flat U-shaped hard plastic underwire adapted to be positioned in the brassiere below the respective cup and along the chest of a wearer and formed with two parallel arcuate portions joined at respective ends and separated by an arcuate slot between the ends; and a soft plastic body in which the hard plastic underwire is embedded, ensheathing the hard plastic underwire along a bottom of the body and having an apron along a concave side of the body lying at an angle to a plane of the hard plastic underwire so that the soft plastic body and underwire of each cup forms a pocket receiving the respective breast, each of the assemblies being affixed to the structure.

The hard plastic wire or armature is not wholly enclosed by the soft plastic and is exposed through windows therein at which the fabric can be attached by ultrasonic welding or laminating when stitching is used to attach the dual wire to the fabric, the stitching may run in the arcuate slit between the parallel arcuate portions.

According to a feature of the invention, while the underwire can be formed from a pair of metal wires interconnected at their ends by respective caps, the underwire is preferably formed in one piece from a hard plastic, for example, polyamide-6,6 or nylon 6,6 or another plastic having a stiffness, rigidity and hardness comparable to that of polyamide-6,6. The soft plastic body is preferably a polyurethane with a Shore hardness 8OA to 9OA or an equivalent soft, flexible and, if desired, elastomeric plastic.

The angle which is included between the plane of the U shaped hard underwire and the a frame can vary along the length of the underwire and corresponds generally to the angle at which a breast to be supported adjoins the chest. Surprisingly, unlike conventional underwire configurations, the underwire assembly forms a cup or pocket itself incorporated into the brassiere cup which receives the breast so that the weight of the breast will draw the ends of the underwire assembly toward one another and thereby counteract the tendency of the tension at the back of the brassiere to spread the underwires.

The body of each underwire assembly can also comprise a tab projecting from a convex side of the body at a location corresponding to a junction region of the cups of the brassiere. The tab also lies at an angle to this plane and like the apron can be provided with throughgoing slits running generally perpendicular to the hard plastic underwire.

To increase the flexibility, cuts are provided through the soft plastic of the body substantially along the arcuate slot.

Spaced apart openings in the body can enable ultrasonic welding of the fabric through these openings to the hard plastic underwire.

The arcuate portions of the hard plastic underwire have generally flat cross sections with the inner arcuate portion being thinner than the outer annular portion.

The arcuate portion along the convex side can be formed along the length thereof with segments of alternatingly greater and lesser thicknesses, thereby producing formations or steps which assist in maintaining the hard plastic underwire in position within the body and preventing shifting.

The assembly can be covered by fabric of the brassiere structure on both sides and that fabric can be stitched through the soft plastic. Preferably however the fabric is laminated to the structure, e.g. by ultrasonic welding. Ultrasonic weld points may pass directly to the hard plastic underwire through openings in the soft plastic body.

When stitching is used to secure the dual wire in the fabric, it runs through the slit in the hard wire between the arcuate portions thereof.

The combination of a hard member which nevertheless is formed with a slit along its length between inner and outer segments with a soft structure in which that hard member is ensheathed, allows advantages of both materials to reinforce one another. The underwire itself is stiff in its plane but because of its arcuate slit can allow the two segments to shift transversely and thereby flex transversely to the plane. It is therefore not rigid in the sense of a body with a solid cross-section (by contrast with a cross section subdivided by a slit). Warping however is largely precluded. The soft material cushions the harder plastic relative to the body over the entire length and provides, because of the apron structure, a pocket or pouch holding the breast. The wire structure thus can hug the breast along its underside and itself be stabilized by the breast.

BRIEF DESCRIPTION OF THE DRAWING

The above and other objects, features, and advantages will become more readily apparent from the following description, reference being made to the accompanying drawing in which.

SPECIFIC DESCRIPTION

Figure 6:
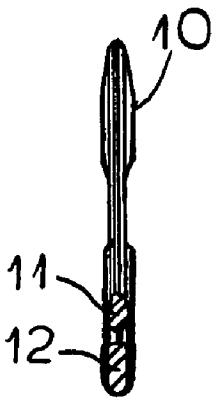
FIG. 6 is a cross sectional view taken along the line VI—VI of FIG. 4.
Figure 5:
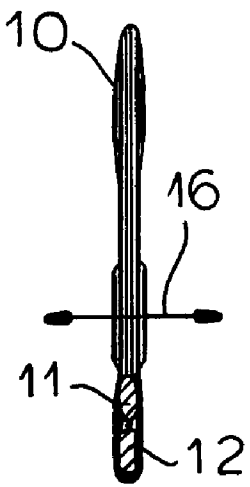
FIG. 5 is a cross sectional view taken along the line V—V of FIG. 4.
Figure 2:
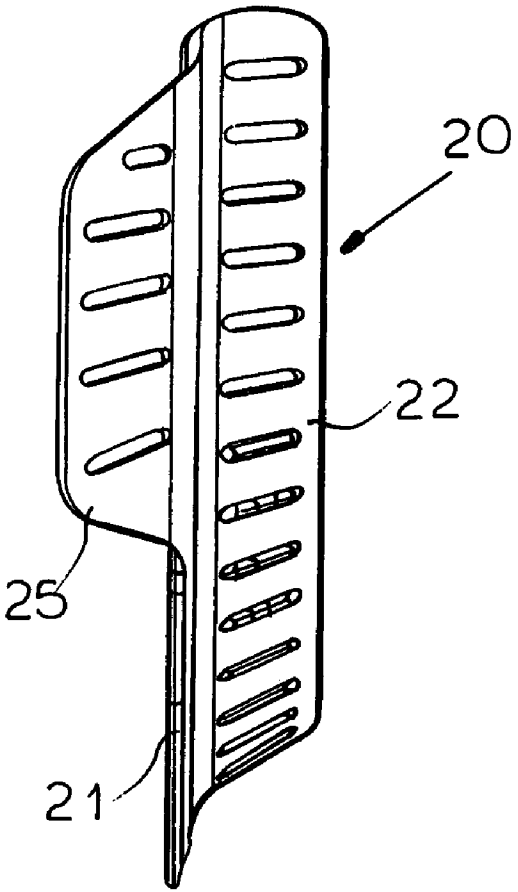
FIG. 2 is a side view of the underwire assembly of FIG. 1.
Figure 4:
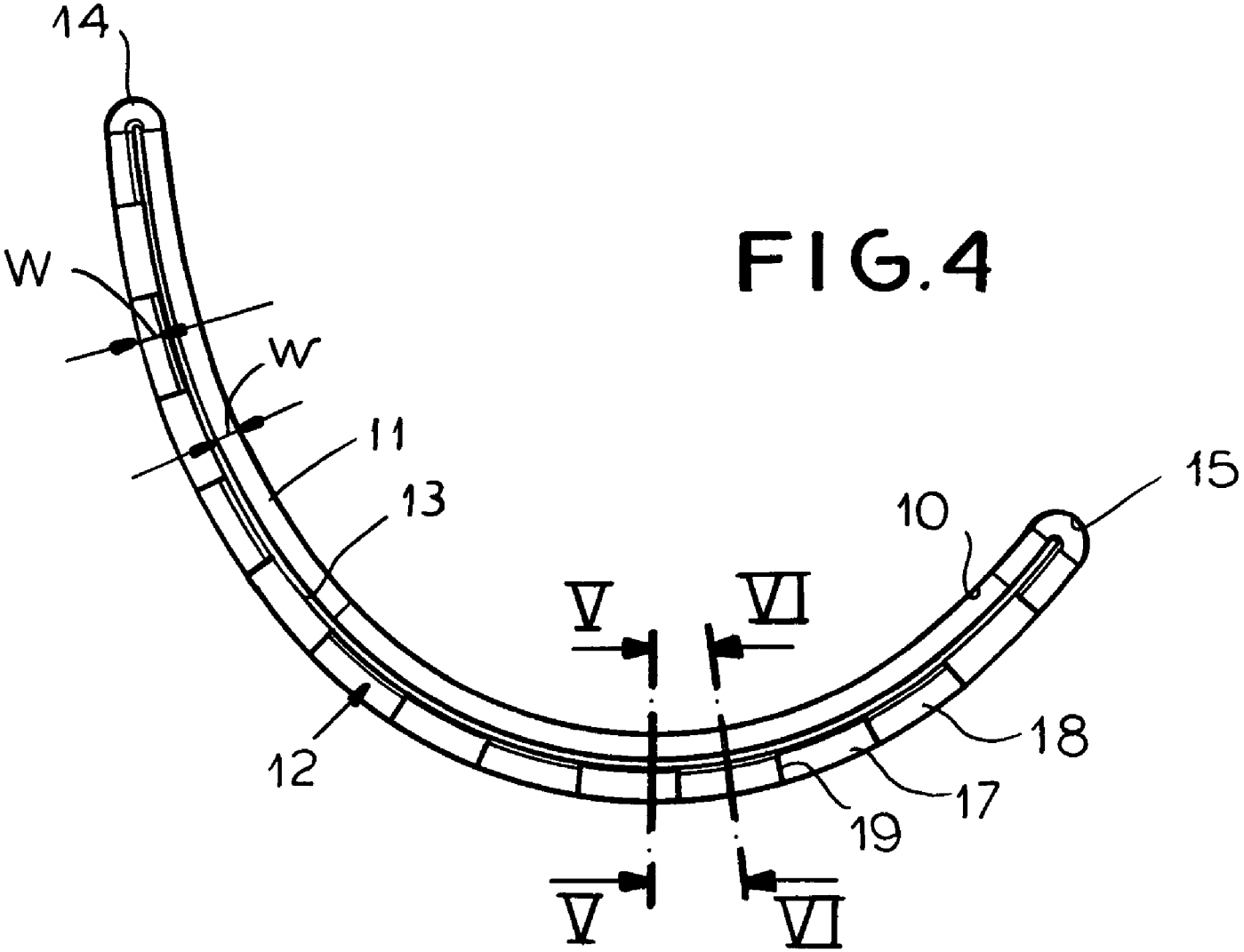
FIG. 4 is an elevational view of the one piece hard plastic underwire incorporated in the assembly of FIGS. 1 through 3.

The key element to the dual wire underwire assembly of the invention is an underwire 10 (FIG. 4) which can be formed of a relatively hard plastic, e.g. polyamide-6,6 or nylon 6,6, which has a flat configuration as can be seen from FIGS. 5 and 6 and comprises an inner arcuate element or portion 11 at the concave side of the generally U-shaped underwire and an outer portion or element 12 parallel to the inner element and located on the convex side of the underwire. An arcuate slit or slot 13 is provided between these two parallel elements which are connected at rounded ends 14 and 15. So that the inner element 11 can flex to either side of the plane of the underwire relative to the outer element as represented by the arrow 16, the width of the inner element 11 may be less than the width W of the outer element. The thickness of the inner element 11 is likewise smaller than that of the outer element 12 (see FIGS. 5 and 6) and the inner element may taper in thickness inwardly while the outer element may taper in thickness outwardly as seen from FIGS. 5 and 6.

In addition, the outer element can be formed with successive regions 17 and 18 alternately of lesser and greater thickness so that steps 19 are formed between these regions and serve as stops, when the underwire is embedded in the soft body to prevent that underwire from shifting in the body in which it is sheathed.

Because one or the other of the arcuate portions can swing relative to another portion, that wire has been referred to as a swing wire and has the properties described in the commonly owned copending application Ser. No. 11/232,424, filed 21 Sep. 2005 which is hereby incorporated in its entirety by reference.

Figure 1:
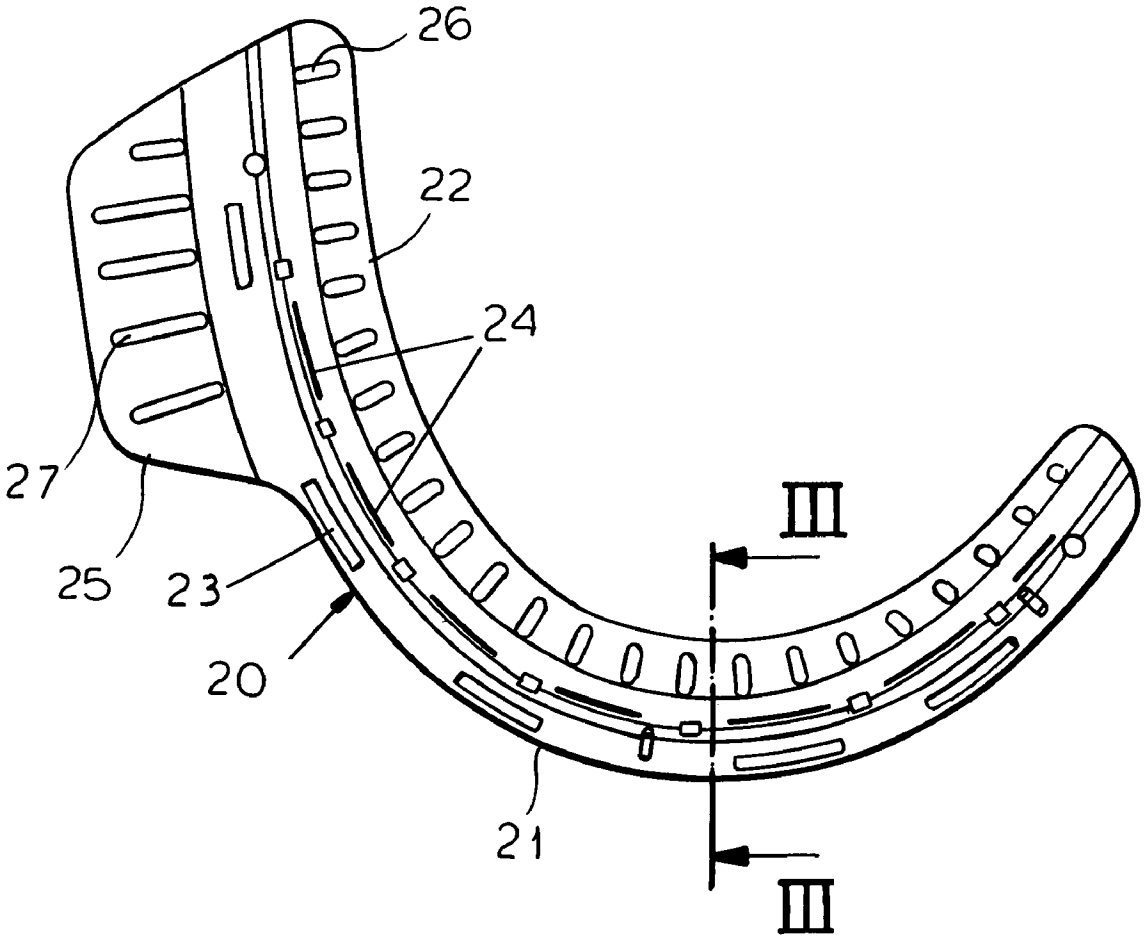
FIG. 1 is a front elevational view of a right breast underwire assembly in accordance with the invention, the left breast underwire assembly being mirror symmetrical thereto.
Figure 3:
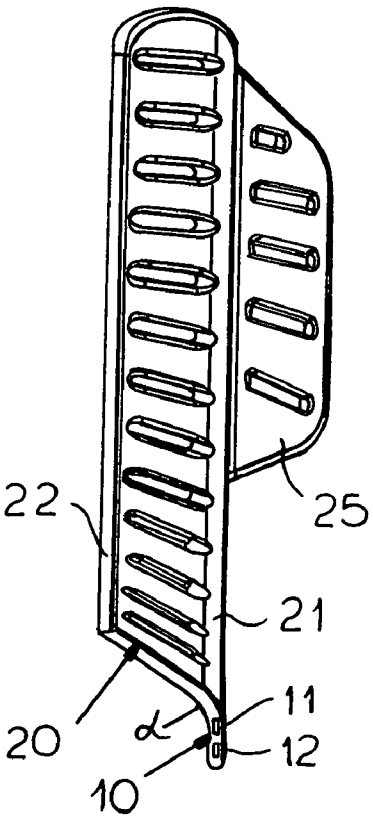
FIG. 3 is a cross sectional view taken along the line III—III of FIG. 1.

According to the present invention, that underwire is not incorporated directly in the brassiere but is partly embedded as shown at 10, 11 and 12 of FIG. 3 in a soft body 20 composed for example of polyurethane with a Shore hardness A of 80 to 90. The body 20 has an arcuate planar portion 21 in which the underwire is ensheathed and an apron 22 which lies at an angle to the plane of the portion 21 and itself forms a pocket that fits around the breast so that the breast can nestle in that pocket. The apron may be formed with spaced apart windows 23 through which a cover fabric can be ultasonically welded to the hard plastic underwire therein and slits may be provided in the body at for example 24 to increase the flexibility. These slits are formed along the slot 13 of the embedded underwire.

The angle $\alpha$ may be $135° \pm 10°$ and may vary by $\pm 10°$, for example, over the length of the assembly.

At one end, the soft plastic body is formed with a tab 25, located toward the armpit area to facilitate retaining the assembly in the brassiere. The angle between the apron 22 and the planar portion 21 can correspond to the angle between the breast and the chest wall against which, through the fabric of the brassiere, the portion 21 will lie. Both the apron 22 and the tab 25 are provided with throughgoing slots 26 and 27 which are perpendicular to the hard plastic underwire which is retained therein.

Figure 7:
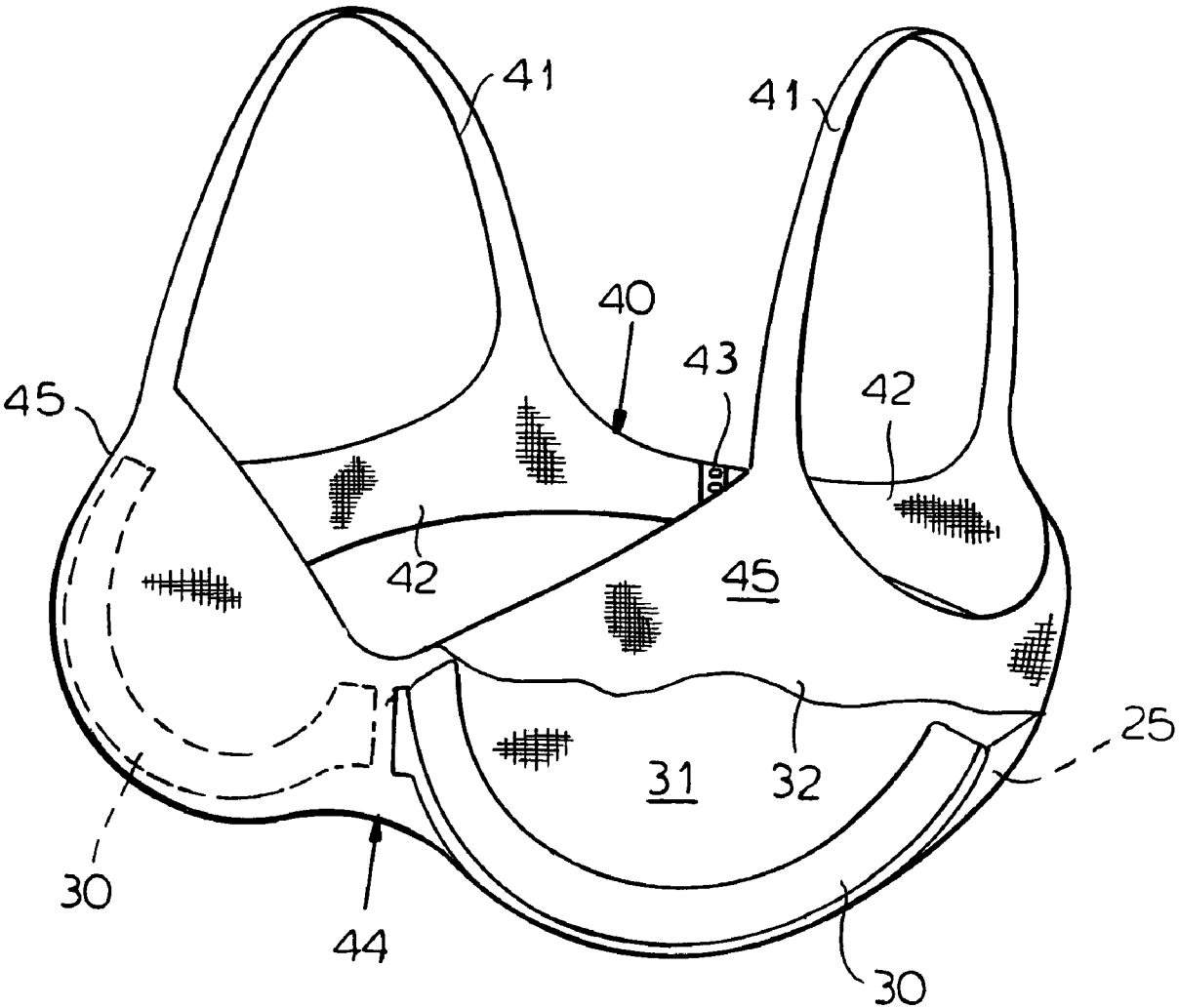
FIG. 7 is a perspective view, partly broken away of the brassiere in which the underwire assemblies are incorporated.
Figure 9:
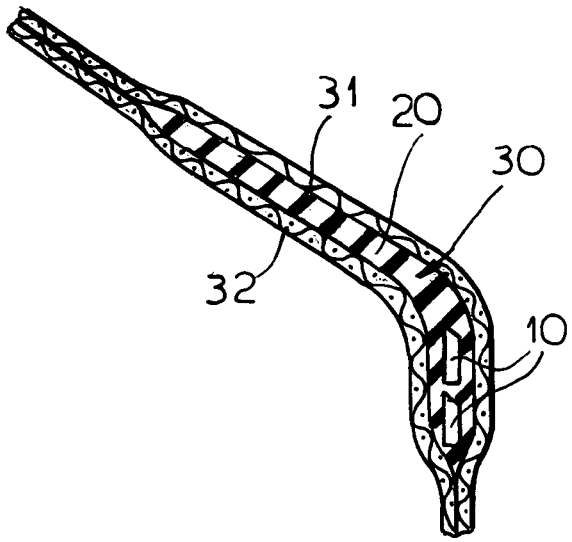
FIG. 9 is a cross sectional view illustrating the lamination of the underwire assembly in a brassiere.
Figure 11:
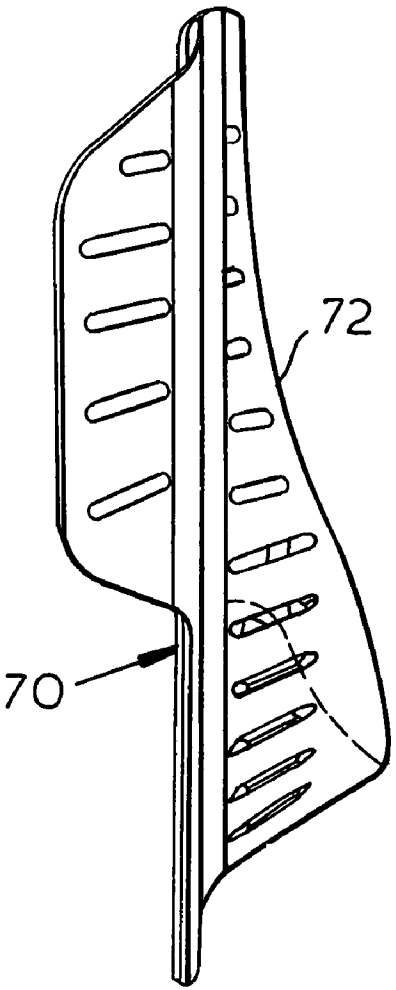
FIG. 11 is a side view similar to FIG. 2 but showing a variation in the width of the apron in accordance with the invention.

As can be seen from FIG. 9, the assembly 30 formed by the soft body 20 and the hard plastic underwire 10 is laminated between fabric layers 31 and 32 which can be ultrasonically welded or stitched through the soft plastic and/or to the hard plastic. The inner fabric layer 31 defines the cup in which the breast rests. This can be seen in greater detail in FIG. 7 which shows a brassiere 40 comprising shoulder straps 41, a pair of back straps 42 connected by a fastener 43 and a brassiere structure 44 comprising two cups 45, each of which is composed of fabric 31, 32 and has an underwire assembly 30 as has been described received therein.

Figure 8:
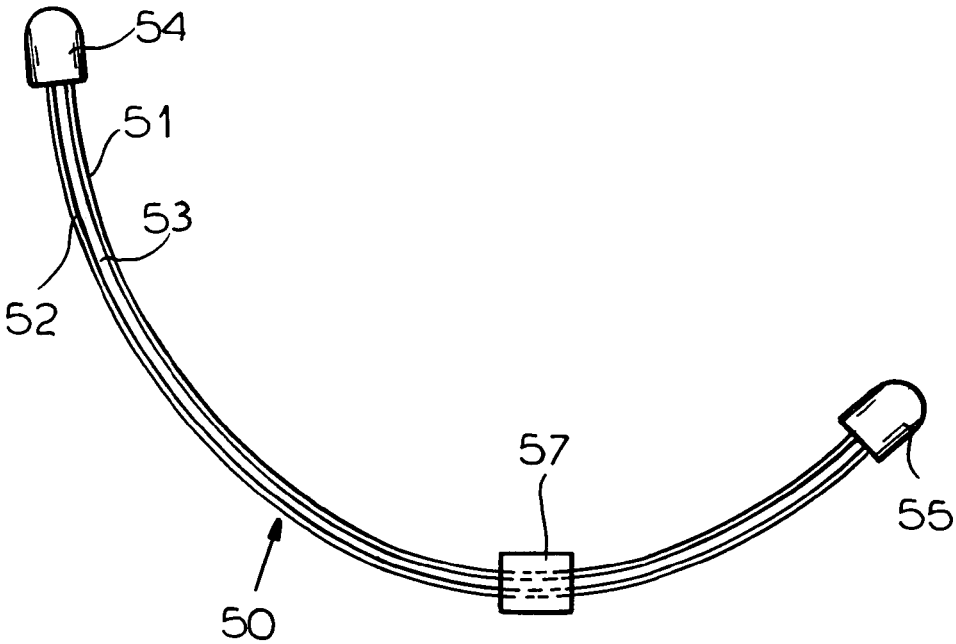
FIG. 8 is an illustration of a metal wire structure which can be incorporated into the soft plastic body.

In a less preferred alternative, the swing wire of FIGS. 1 through 6 can be replaced by a metal wire assembly as shown in FIG. 8 which can have a pair of metal wires 51 and 52 joined by caps 54 and 55 at their ends and preferably at a midpoint or close to a midpoint by a member 57. By reason of the gap 53 between the wires, a swinging of one wire relative to another out of the plane and swivelling within member 57 is permitted. The caps 54 and 55 of the metallic wire 50 and member 57 prevent shifting in the soft body when the soft body is molded therearound otherwise the soft body functions in the same manner as the soft body 20 of the first embodiment.

Figure 10:
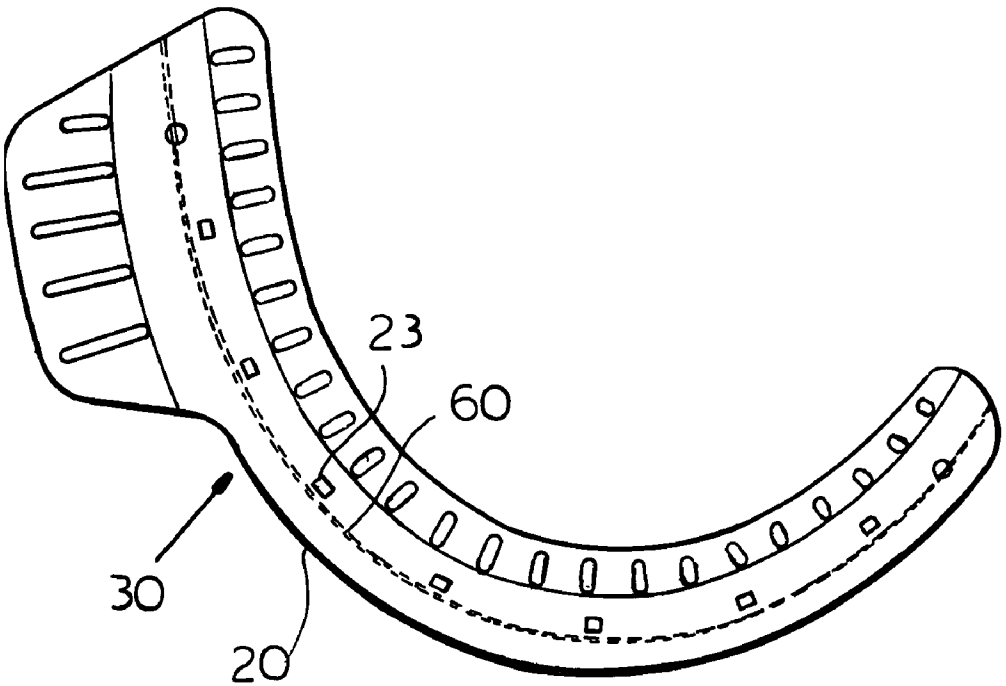
FIG. 10 is a view similar to FIG. 1 showing the stitching line when stitching is used to attach the fabric to the dual wire.

In FIG. 10 we have shown the dual wire arrangement 30 in which the soft body 20 is stitched through Along a stitching line 60 which can run in the slit 13 between the arcuate portions 11 and 12 of the underwire 10 which is not visible in FIG. 10 but is exposed through the openings 23 normally provided to allow the fabric also to be welded to the hard plastic wire if desired. In the assembly 70, the apron 72 of the soft body has a different configuration from the apron 22. In this embodiment the apron, which is part of the cup, is reduced toward the ends with its width greatest toward the deepest part for the dual wire. As a result, the weight of the breast can draw the ends together as has been described, to a greater extent, in opposition to the back wings which tend to spread the wire apart.

We claim:

1. An underwire assembly adapted to be incorporated into a brassiere, said assembly comprising:

a generally flat U-shaped hard underwire adapted to be positioned in a brassiere below a cup thereof and along the chest of a wearer, said underwire being formed with two parallel arcuate portions joined at respective ends and separated by an arcuate slot between said ends; and a soft plastic body in which said hard underwire is partially embedded, ensheathing said hard underwire along a bottom of said body and having an apron along a concave side of said body lying at an angle to a plane of the hard underwire so that said body and said underwire form a pocket receiving a breast of the wearer in said cup.

2. The underwire assembly defined in claim 1 wherein said underwire is formed from a pair of wires interconnected at their ends by respective caps and at least one member between said caps, whereby said caps and said member prevent shifting of said underwire in said body.

3. The underwire assembly defined in claim 1 wherein said underwire is formed from a plastic.

4. The underwire assembly defined in claim 3 wherein said angle corresponds substantially to an angle at which a breast to be supported with the assembly adjoins the chest.

5. The underwire assembly defined in claim 3 wherein said body further comprises a tab projecting from a convex side of said body at a location corresponding to a junction region of the cups of the brassiere.

6. The underwire assembly defined in claim 5 wherein said tab lies at an angle to said plane.

7. The underwire assembly defined in claim 5 wherein said tab is provided with an array of throughgoing slits generally perpendicular to said hard plastic underwire.

8. The underwire assembly defined in claim 3 wherein said apron is provided with an array of throughgoing slits substantially perpendicular to said hard plastic underwire.

9. The underwire assembly defined in claim 3, further comprising flexibility increasing cuts in said body substantially along said arcuate slot.

10. The underwire assembly defined in claim 3, further comprising spaced apart openings in said body enabling ultrasonic welding of a fabric therethrough to said hard plastic underwire.

11. The underwire assembly defined in claim 3 wherein said arcuate portions of said hard plastic underwire have generally flat cross sections.

12. The underwire assembly defined in claim 11 wherein the inner arcuate portion is thinner than the outer annular portion.

13. The underwire assembly defined in 3 wherein said hard plastic underwire is formed in one piece.

14. The underwire assembly defined in claim 3 wherein the arcuate portion along the convex side of said underwire is formed along the length thereof with segments of alternatingly greater and lesser thickness.

15. The underwire assembly defined in claim 3 wherein said angle is about 135°±10° as measured as the included angle between the ensheathed hard plastic underwire and the apron.

16. A brassiere comprising a fabric structure formed with two brassiere cups interconnected at a front part of the brassiere and respective underwire assemblies incorporated in said structure to support each of said cups, each of said assemblies comprising:

a generally flat U-shaped hard plastic underwire adapted to be positioned in the brassiere below the respective cup and along the chest of a wearer and formed with two parallel arcuate portions joined at respective ends and separated by an arcuate slot between said ends; and a soft plastic body in which said hard plastic underwire is partially embedded, ensheathing said hard plastic underwire along a bottom of said body and having an apron along a concave side of said body lying at an angle to a plane of the hard plastic underwire so that the soft plastic body and underwire of each cup forms a pocket receiving the respective breast, each of said assemblies being affixed to said structure.

17. The brassiere defined in claim 16 wherein each assembly is covered by fabric of said structure on opposite sides of the assembly and is stitched to the fabric.

18. The brassiere defined in claim 16 wherein each assembly is covered by fabric of said structure on opposite sides of the assembly and is ultrasonically laminated to the fabric.

19. The brassiere defined in claim 18 wherein said fabric is at least in part ultrasonically welded to the underwires.

20. The brassiere defined in claim 16 wherein said fabric has ultrasonic weld points directly to said hard plastic underwire through openings in said soft plastic body.

21. The brassiere defined in claim 16 wherein each said body further comprises a respective tab projecting from a convex side of the respective body at a location corresponding to a junction region of the cups of the brassiere.

22. The brassiere defined in claim 21 each of said tabs lies at an angle to the plane of the respective hard plastic underwire.

23. The brassiere defined in claim 21 wherein said tab is provided with an array of throughgoing slits generally perpendicular to said hard plastic underwire and said apron is provided with an array of throughgoing slits substantially perpendicular to said hard plastic underwire.

24. The brassiere defined in claim 21, further comprising flexibility increasing cuts in each of said bodies substantially along the respective arcuate slot, each of said bodies having spaced apart openings enabling ultrasonic welding of a fabric therethrough to said hard plastic underwires.

25. The brassiere defined in claim 16 wherein said bodies are composed of soft polyurethane with a Shore hardness of 80 A to 90 A and said underwire is composed of polyamide 6,6.

* * * * *